US006335517B1

(12) United States Patent
Chauviaux et al.

(10) Patent No.: US 6,335,517 B1
(45) Date of Patent: Jan. 1, 2002

(54) HUMIDIFIER HAVING INDUCTION HEATING SYSTEM

(75) Inventors: Gabriel Chauviaux, Laval; Paul Dery; Yves Poirier, both of Montreal, all of (CA)

(73) Assignee: The Holmes Group, Inc., Milford, MA (US)

( * ) Notice: Subject to any disclaimer, the term of this patent is extended or adjusted under 35 U.S.C. 154(b) by 0 days.

(21) Appl. No.: 09/553,190

(22) Filed: Apr. 20, 2000

Related U.S. Application Data

(60) Provisional application No. 60/136,500, filed on May 28, 1999.

(51) Int. Cl.[7] ..... H05B 6/10
(52) U.S. Cl. ..... 219/628; 219/630
(58) Field of Search ..... 219/618, 628, 219/629, 630, 631, 438, 523; 392/324, 325; 261/142

(56) References Cited

U.S. PATENT DOCUMENTS

| | | | | | |
|---|---|---|---|---|---|
| 3,215,416 | A | * | 11/1965 | Liben | 219/628 |
| 3,584,192 | A | * | 6/1971 | Maag | 219/523 |
| 4,013,742 | A | * | 3/1977 | Lang | 219/628 |
| 4,341,936 | A | * | 7/1982 | Virgin | 219/630 |
| 4,734,561 | A | * | 3/1988 | Miller | 219/438 |
| 5,286,942 | A | * | 2/1994 | McFadden et al. | 219/630 |

* cited by examiner

*Primary Examiner*—Tu Ba Hoang
(74) *Attorney, Agent, or Firm*—Hoffmann & Baron, LLP; Francis E. Marino

(57) ABSTRACT

A portable humidifier is provided which includes an induction heating system. The system includes an inductor coil and a metal target which functions as a heating element. The metal target is positioned within a tray beneath the inductor coil. The tray is adapted for holding water. The target is coupled to a float, which allows it to move towards or away from the inductor coil depending upon the water level in the tray.

30 Claims, 13 Drawing Sheets

HUMIDIFIER HAVING INDUCTION HEATING SYSTEM

CROSS-REFERENCE TO RELATED APPLICATION

This application is based on and claims priority to U.S. Provisional Patent Application Ser. No. 60/136,500, which was filed on May 28, 1999, the disclosure of which is incorporated herein by reference.

BACKGROUND OF THE INVENTION

1. Field of the Invention

The field of the invention relates to humidifiers including induction heating systems for generating steam, a method of providing humidity and to various components of induction type humidifiers.

2. Brief Description of the Related Art

Induction heating involves the heating of a metal target or workpiece by an induced current. Such heating has been used for various purposes, including the heating of water. U.S. Pat. Nos. 4,013,742; 4,341,936 and 5,286,942 disclose systems for producing steam through the use of inductor coils and metal targets.

SUMMARY OF THE INVENTION

A portable humidifier is provided for use in the home, office or other suitable location. The humidifier includes an inductor coil for heating a heating element. It accordingly requires no direct electrical connection between the power source and heating element.

A humidifier in accordance with the invention includes a tray defining a chamber for holding water, and a metal target movably positioned within the chamber. A float is coupled to the metal target, and provides buoyancy when the tray is filled with water. An inductor coil is provided for heating the target. The inductor coil is separated from the target by a wall.

The invention is further directed to a humidifier which includes a removable tray for holding water, a metal target movably positioned in the tray, an inductor coil for heating the metal target with an induced current, and a wall separating the inductor coil and metal target. The metal target is engageable with the wall. Channels are preferably provided between the wall and the target to allow water to flow therebetween.

The invention further provides a humidifier including a tray for holding water, a metal target movably positioned within the tray, an inductor coil for heating the metal target, a wall separating the inductor coil and metal target, and means for deenergizing the coil when the water level in the tray drops below a predetermined level. The deenergizing means may include an inductor sensor which senses a decrease in the induction current should the target move away from the inductor coil. Such a sensor may cause a switch between the power source and the inductor coil to open upon sufficient displacement of the target, whether due to a low water level or separation of the tray and inductor coil.

A portable humidifier is also provided which includes a tray for holding water, a metal target within the tray, a wall separating the metal target and the inductor coil, the target positioned beneath and engaging the wall, and a plurality of channels between the metal target and the wall for allowing the passage of water therein.

A method for providing humidity is further provided by the invention. The method includes the steps of providing a tray, a metal target within the tray, an inductor coil and a wall separating the inductor coil and the target, providing water to the tray, maintaining the target at a position corresponding to the water level in the tray, and supplying power to the induction coil, thereby causing the target to heat the water sufficiently to produce steam.

DETAILED DESCRIPTION OF THE INVENTION

Figure 1:
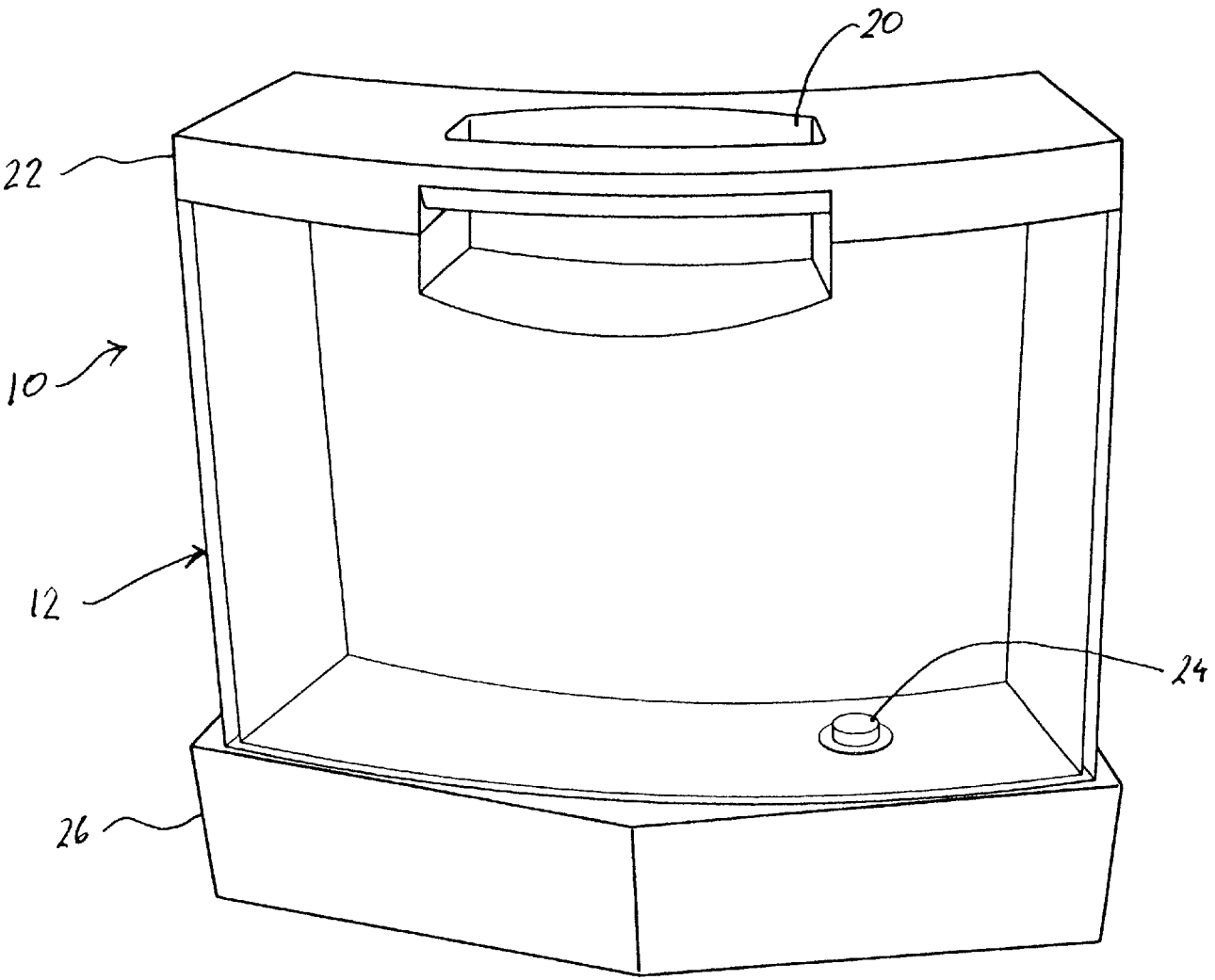
FIG. 1 is a top perspective view of a humidifier according to the invention.

A portable humidifier 10 is provided for use in the home, the office, or other suitable location. The humidifier includes a water tank 12, a tray 14 or other suitable receptacle for receiving water from the tank, a target 16 positioned within the tray, and an inductor coil 18 for heating the target. The water tank 12 is preferably removable to facilitate refilling and/or cleaning. A handle 20 is accordingly provided near the top of the tank, and may be integral with a tank cover 22. The tank cover 22 is mounted to the tank to protect the contents thereof. The cover is preferably bonded to the tank, but can be removable if desired. While the tank is preferably cleanable and reusable, a disposable tank could alternatively be employed.

A conventional tank valve 24 or other suitable means are provided for releasing water from the tank in a controlled manner. Tank valves are well known to the art, and are employed in commercially available humidifiers of various types. While more sophisticated water delivery means, such as a pump, could be employed, tank valves are economic and reliable for use in the consumer market.

Figure 2:
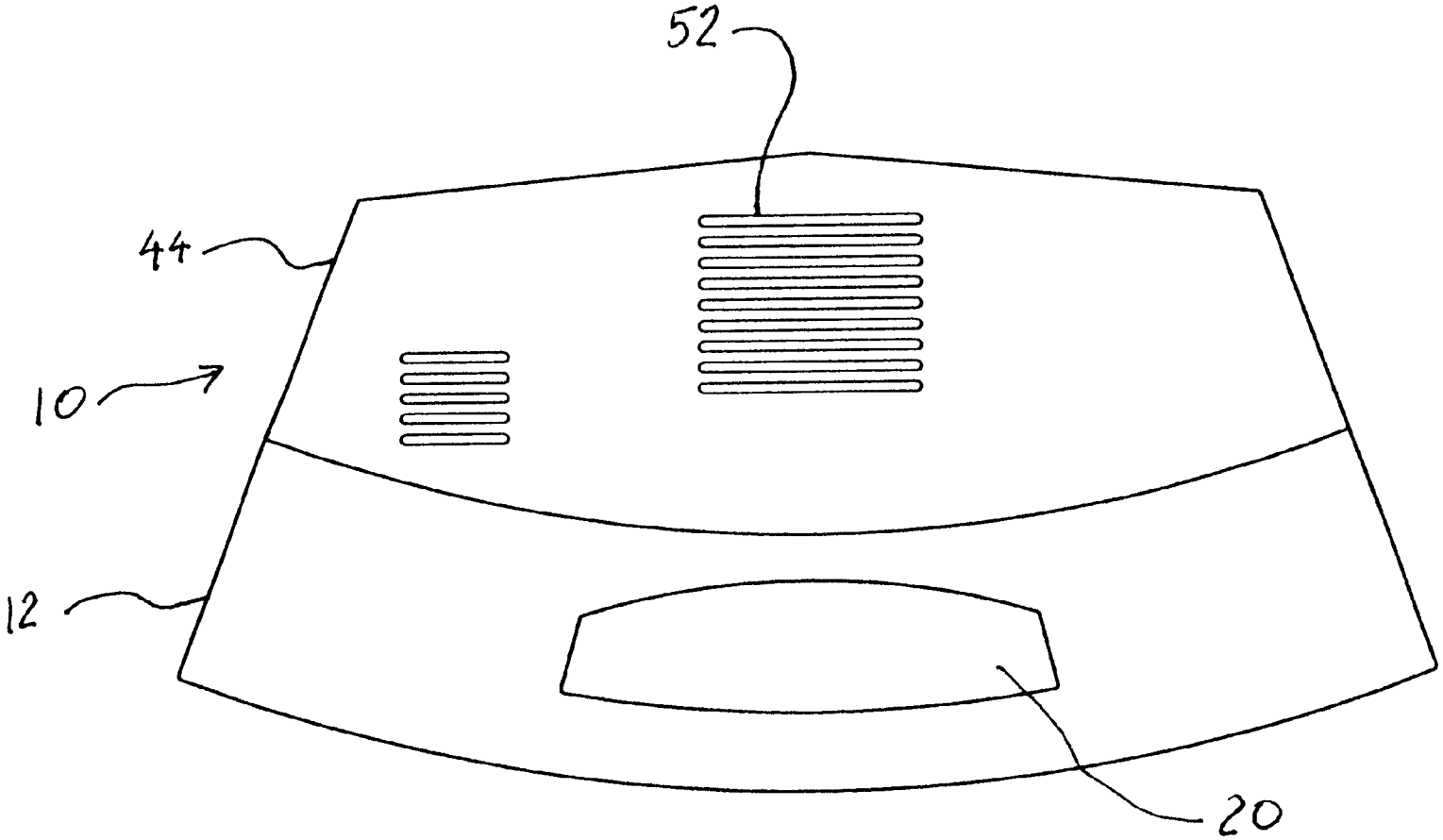
FIG. 2 is a top plan view thereof.
Figure 3:
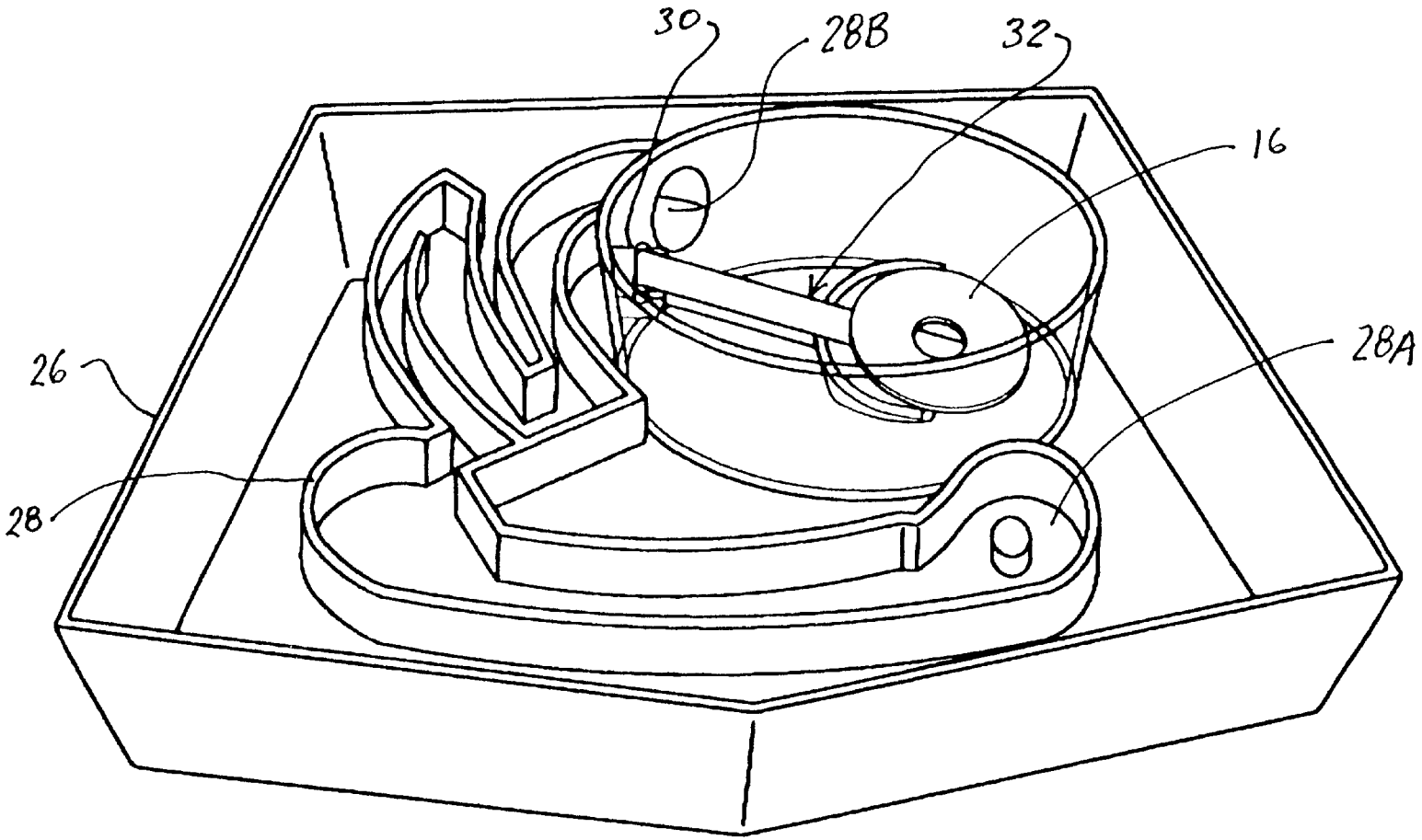
FIG. 3 is a front perspective view of the base of the humidifier and components within the base.
Figure 4:
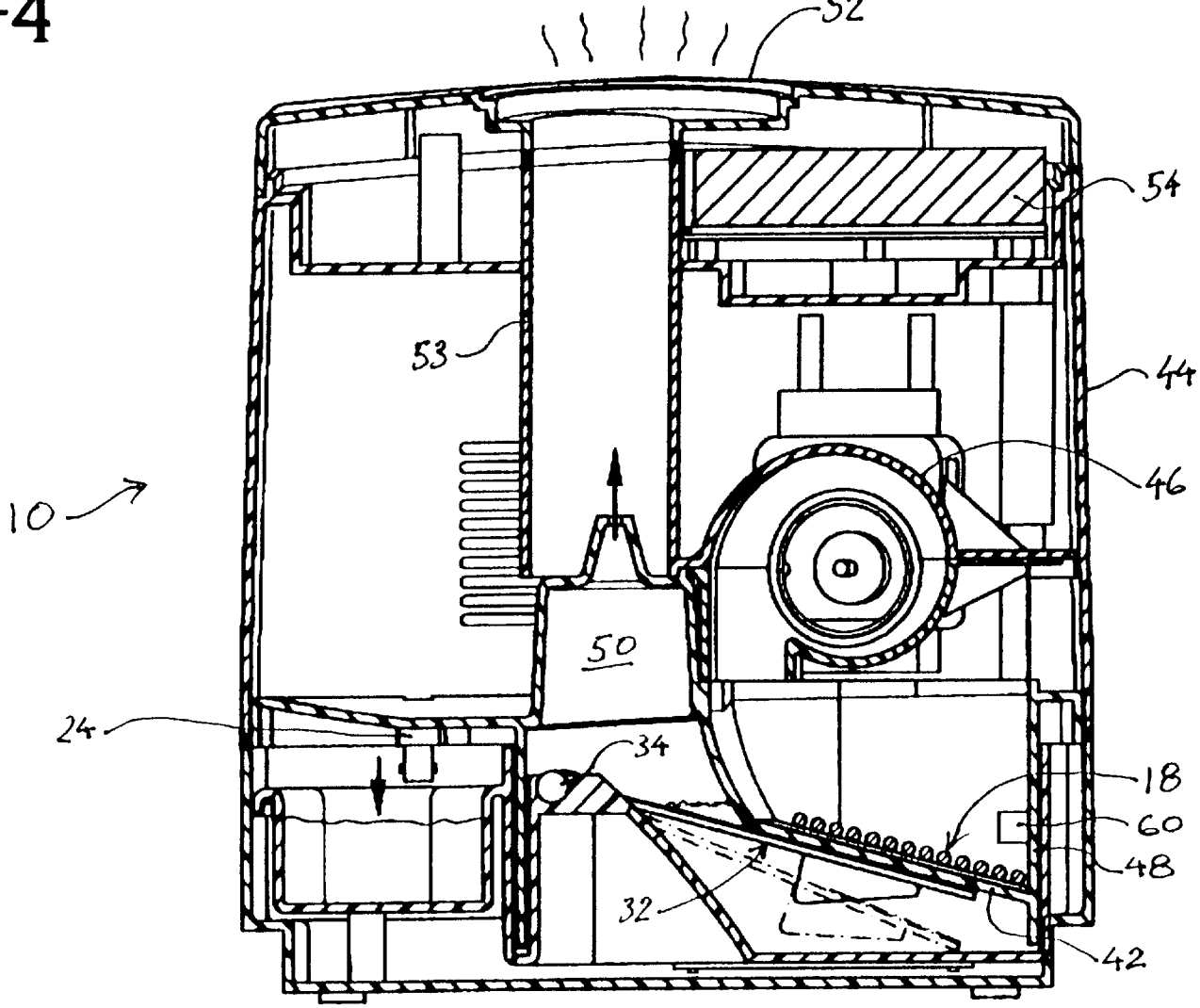
FIG. 4 is a sectional, elevation view of a humidifier in accordance with the invention.

As shown in FIGS. 3 and 4, the tray 14 is positioned within a base 26. (FIG. 4 is a schematical illustration of the invention, and is not intended to correlate precisely with the humidifier shown in FIGS. 1–3. The same reference numerals are used in FIGS. 1–7 to designate similar parts.) The base includes bottom and side walls which together define an enclosure for the tray and other elements. An elongate, tortuous channel 28 is provided within the base. One end 28A of the channel is positioned beneath the tank valve 24. The other end 28B of the channel is in fluid communication with the tray 14, which has an opening in a side wall thereof for admitting water into the tray from the channel. The use of a tortuous channel is preferred in order to substantially confine the hot water within the tray. Backflow through the tortuous path is very limited. The tray 14 and channel 28 are both preferably removable from the base 26 to facilitate washing.

The tray 14 includes a support 30 for a float and target assembly 32, as shown in FIGS. 3 and 4. The support is preferably, but not necessarily, integral with the tray. It includes a fitting 34 for receiving a pivot pin.

Figure 5A:
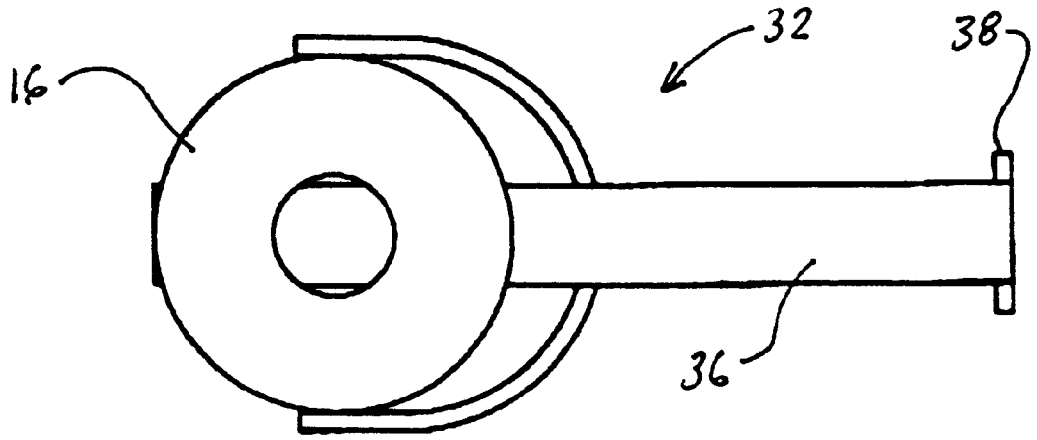
FIG. 5A is a top plan view of a float and target assembly for the humidifier.
Figure 5B:
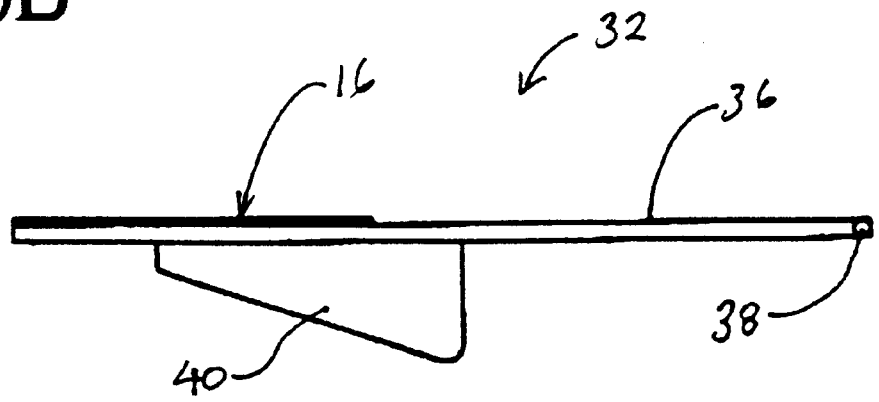
FIG. 5B is a side elevation view thereof.

As best shown in FIGS. 5A and 5B, the float and target assembly 32 is comprised of an arm portion 36 having a pivot pin 38 at one end and the metal target 16 in the form of a flat, stainless steel ring at the other end. The pivot pin, which is preferably integral with the arm, is used for pivotally securing the assembly to the support 30. There should be sufficient play between the pin and fitting that pivotal movement of the assembly is substantially unimpeded. The particular manner in which the assembly is coupled to the support is not considered to be critical so long as the target is capable of moving towards and away from the inductor coil 18. A living hinge may, for example, be used to couple the assembly to the support or another portion of the tray 14. The target and inductor coil are preferably substantially parallel to each other as well as in close proximity when the humidifier is operated.

The float and target assembly 32 further includes a float 40 either integral with or coupled to the arm. In the embodiment shown in FIG. 5B, the float is in the form of an air-tight compartment including a chamber filled with air. The float provides sufficient buoyancy that the target will be maintained at or just below the water level in the tray 14. As discussed below, the target is positioned in close proximity to a wall separating it from the inductor coil, and preferably in engagement with the wall. Buoyancy may alternatively be provided by employing an appropriate foam material integral with, coupled to or comprising the arm.

Figure 7:
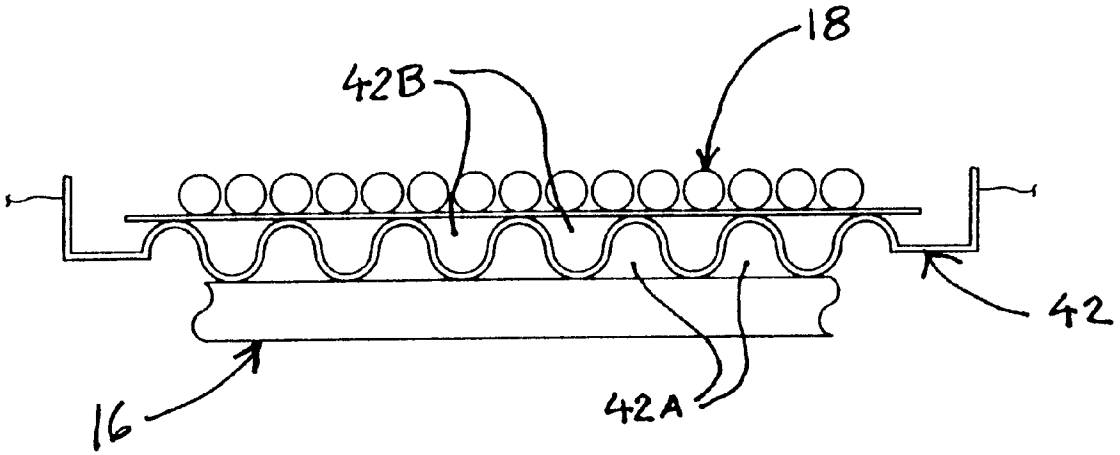
FIG. 7 is an enlarged sectional view showing a corrugated wall separating the inductor coil and target.

One of the advantages of induction heating is that no direct coupling is required between the heating element and power source. The lack of such coupling obviates the need for seals and electrical connections, which are potential problem areas in prior art warm mist humidifiers. The heating element, i. e., the target 16, is separated from the inductor coil 18 and other electrical components by a bottom wall 42 of a housing 44. The housing 44 is removably coupled to the base 26. The bottom wall 42 is preferably corrugated on both surfaces, as shown in FIG. 7. As the target preferably engages and makes substantially flush contact with the bottom wall during operation of the humidifier, the corrugations or other irregularities in the wall surface allow water to move in channels 42A formed between the target and the inductor coil, and be converted to steam. They also increase the surface area of the target in contact with the water. The air spaces 42B between the upper surface of the bottom wall and the lower surface of the inductor coil permit air circulation between these elements. A fan 46 is provided within the housing 44 to provide air circulation throughout the chamber defined by the housing. It will be appreciated that the inductor coil could alternatively be positioned in a water-tight portion of the base 26 such that the bottom wall of the tray separates the inductor coil and target. The target would instead move towards the bottom of the tray as the tray filled with water, as opposed to moving upwardly in the preferred embodiment of the invention. Such movement could be effected by a float connected to the target, but positioned on the opposite side of a pivotable support.

As shown in FIG. 4, the bottom of the housing includes an extension 48 which is positionable within the tray 14. The extension includes a side wall defining an enclosure having an open bottom end and a top wall defined in part by the corrugated wall 42. An opening 50 is provided in the bottom wall of the housing 44. This opening is in fluid communication with the tray 14, and allows the escape of steam. The outer wall of the housing 44 includes one or more vent openings 52 which allow the steam to exit the humidifier. The vent openings 52 may be connected to the wall opening 50 by a chute 53. Movement of the steam from the humidifier may be facilitated by the internal pressure in the housing caused by the fan, or by an additional fan (not shown). The temperature of the steam/air mixture emitted from the humidifier can be reduced in such a manner.

In addition to containing the fan 46, the housing 44 contains the electronic assembly 54 for providing power to the inductor coil 18 and fan, and for controlling their operation. The manner in which the humidifier is controlled in accordance with the preferred embodiment is described later below.

Figure 6:
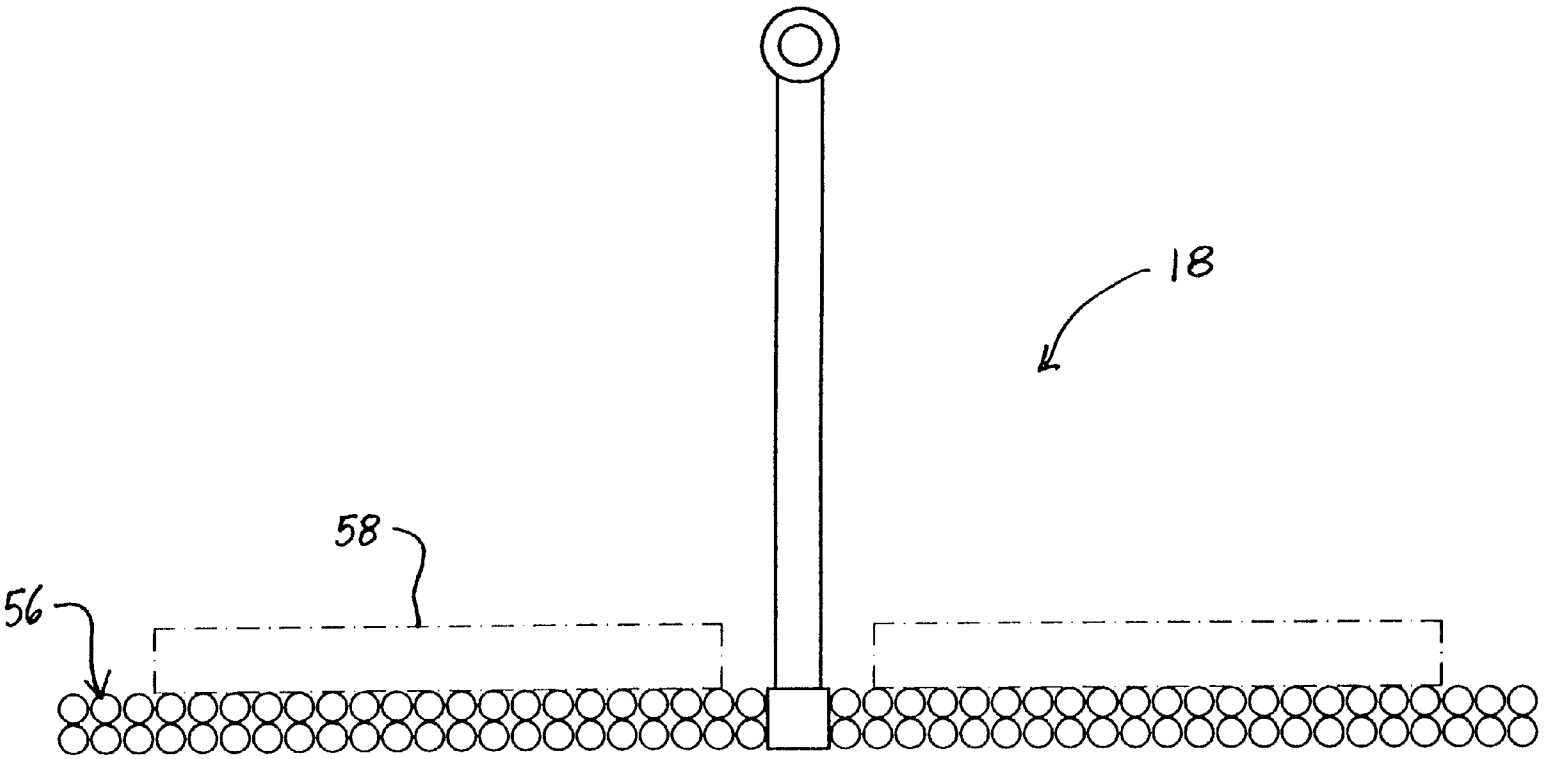
FIG. 6 is a partially sectional, elevation view of an inductor coil for the humidifier.

Referring now to FIG. 6, the inductor coil 18 is shown as comprising a flat ring 56 comprised of two wire spirals, one spiral being positioned directly on top of the other. The two spirals are formed from a single wire, each of which extends clockwise. The preferred material for the inductor coil is Litz wise, but a solid wire could instead be used, albeit with lower efficiency. An insulation varnish or the like is used to maintain the spirals in position. The wire ends extending from the inductor coil are protected by a high temperature sleeve, and are coupled to appropriate terminals. Four ferrite blocks 58 are glued to the top surface of the flat ring. The inductor coil (and resonant circuit) is fed by a rectified alternating current. The current is switched at a frequency around 30 HZ by a switching transistor. The particular type of inductor coil is not considered critical so long as it is capable of heating the metal target 16 sufficiently to create steam in an efficient manner. Likewise, the composition of the target is not critical provided it can be heated safely and reliably by the inductor coil.

Figure 8A:
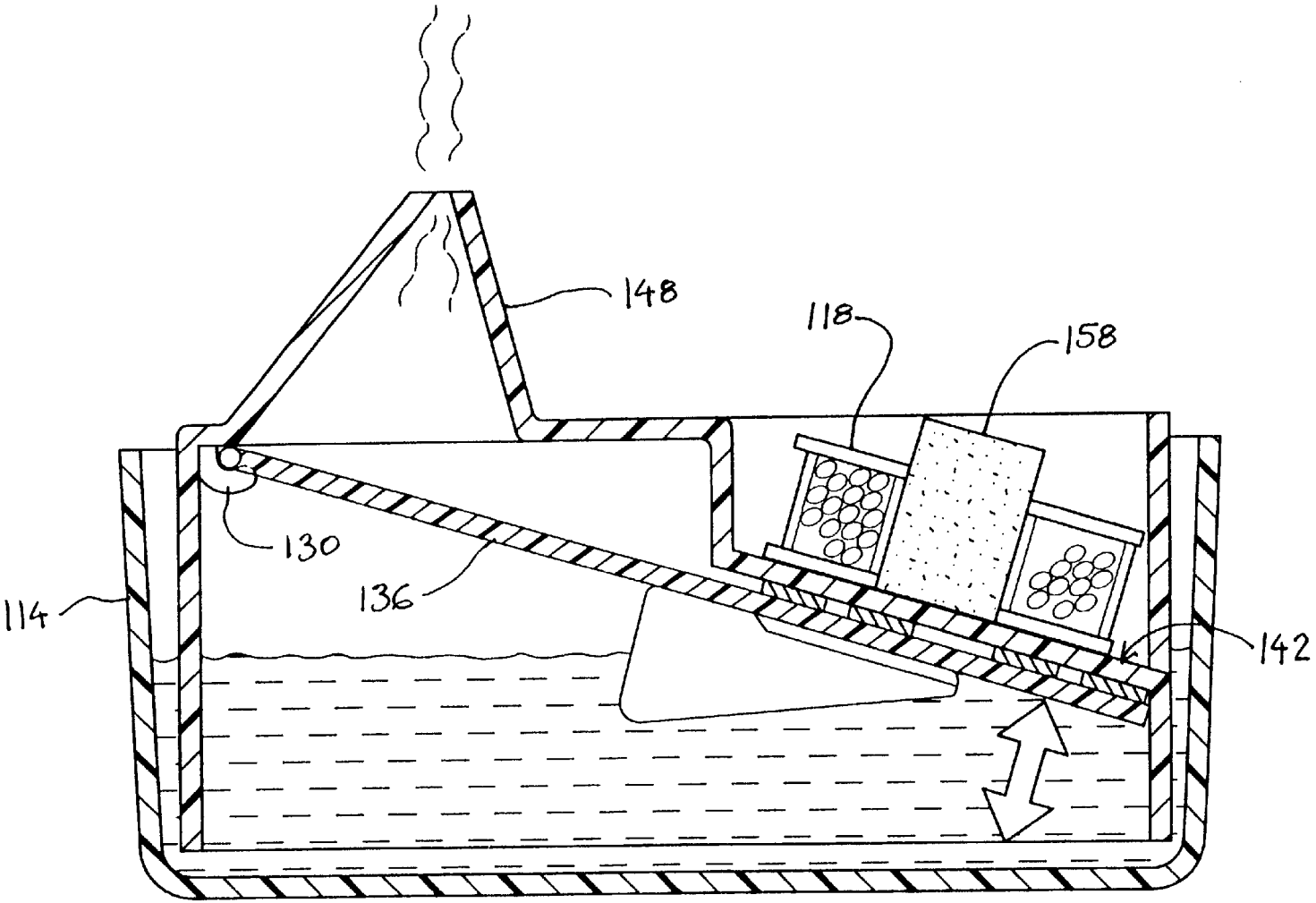
FIG. 8A is a sectional view showing an alternative embodiment of the portion of the humidifier used for making steam.
Figure 8B:
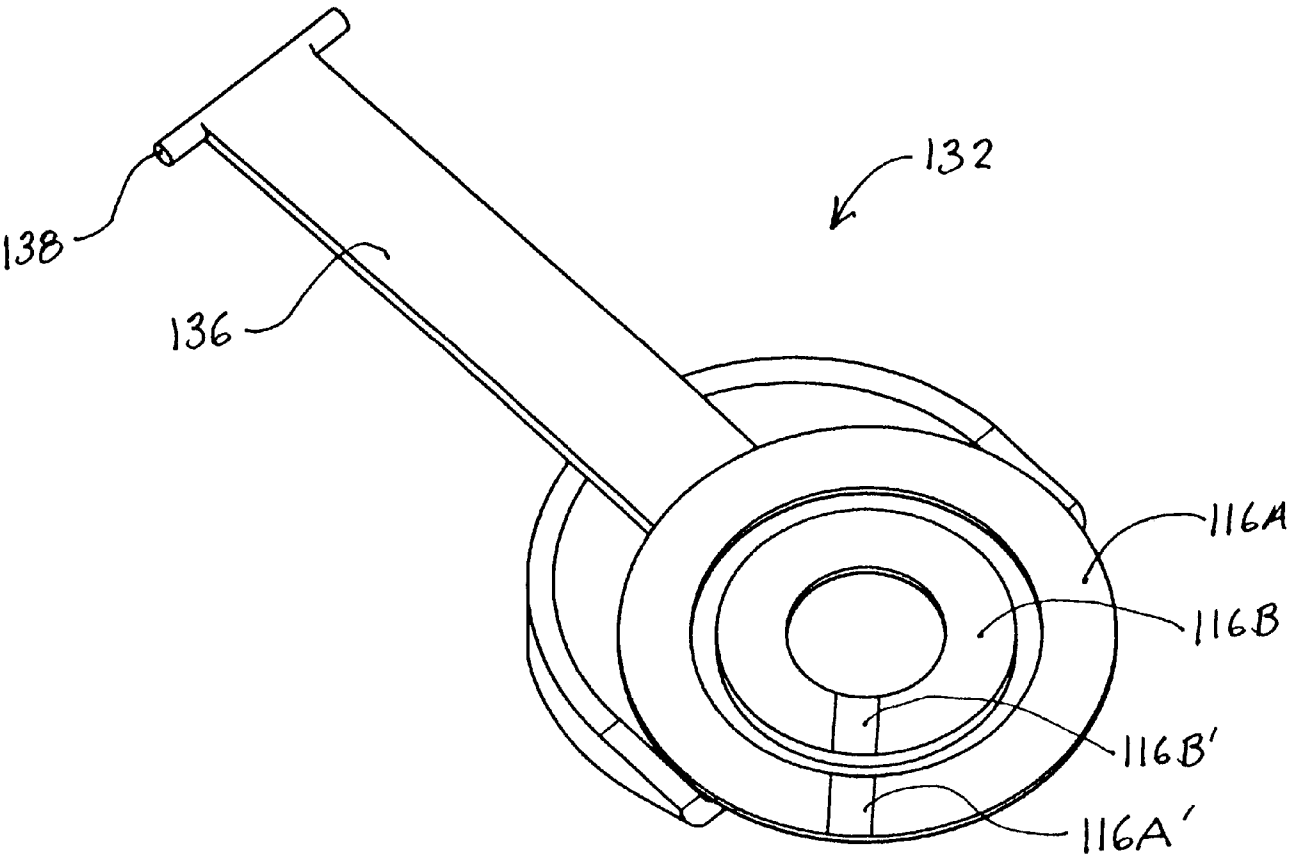
FIG. 8B is a top perspective view of the target and float assembly for this alternative embodiment.

FIG. 8A shows an alternative embodiment of the invention. (The embodiment of FIGS. 1–7 is the preferred embodiment.) The water supply and electronic assembly as discussed above are usable with this and other embodiments of the invention described hereafter. FIG. 8B shows a target assembly 132 usable with this or one of the other disclosed embodiments.

Referring to FIG. 8A, a tray 114 is provided for holding the water to be converted to steam. A cover or housing extension 148 is mounted to the tray, which together define a boiling chamber. The target assembly 132 in this embodiment is pivotally coupled to a support 130 mounted to the cover 148. It is comprised of an arm portion 136 having lateral extensions 138 formed at one end and a pair of concentric metal rings 116A, 116B secured to the opposite end. A float 140 is coupled to the bottom portion of the arm portion 136. The target rings 116A, 116B each include a fusible section 116A', 116B'. These sections are designed to melt should the temperatures of the rings exceed a predetermined level.

The inductor coil 118 rests upon an upper wall 142 of the cover 148, and includes a ferrite core 158. As shown in the previous embodiment, water should be able to enter into spaces or channels between the target and wall 142, while air should be able to circulate between the inductor coil and the wall.

Figure 9A:
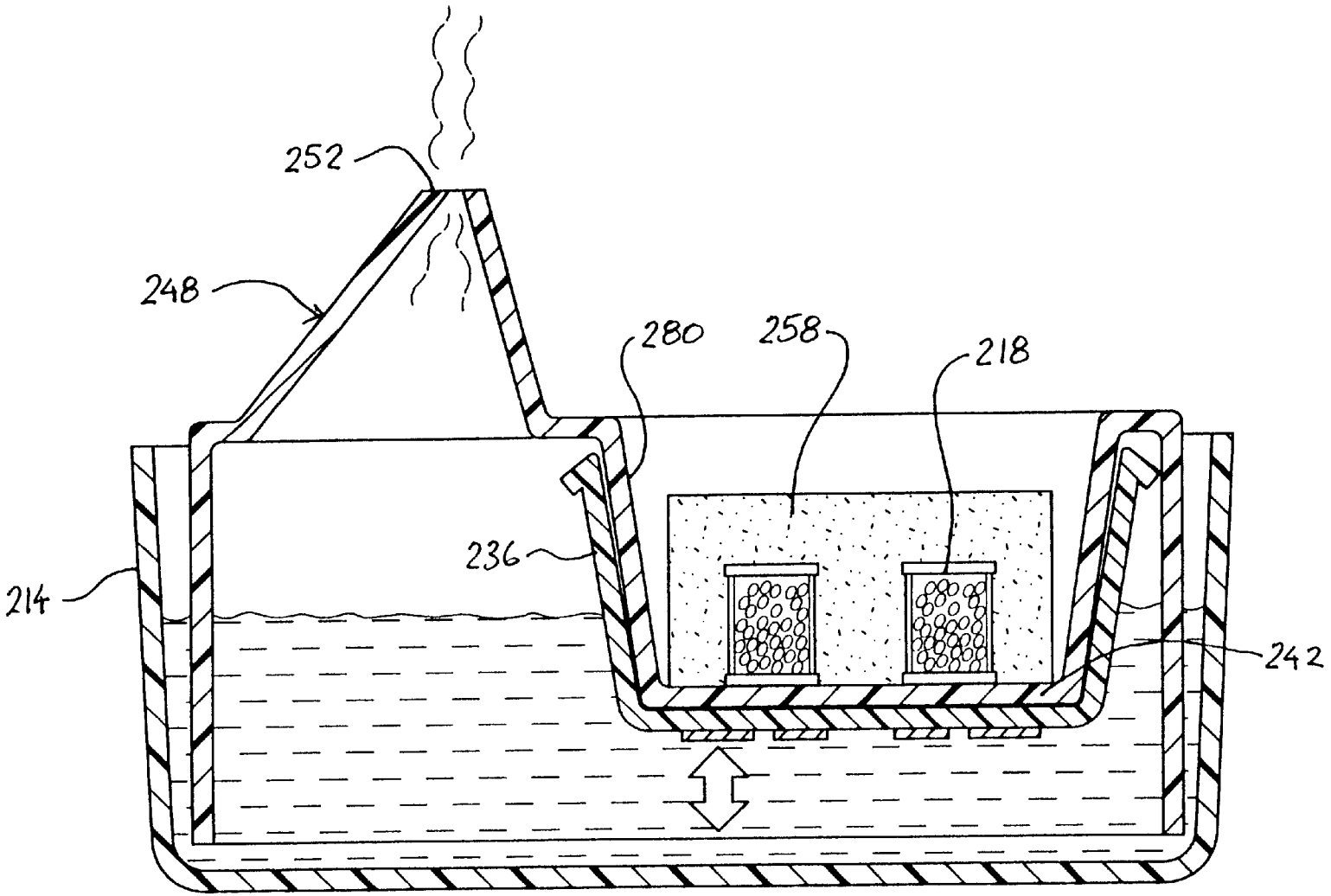
FIG. 9A is a sectional elevation view showing a second alternative embodiment of the portion of the humidifier used for making steam.
Figure 9B:
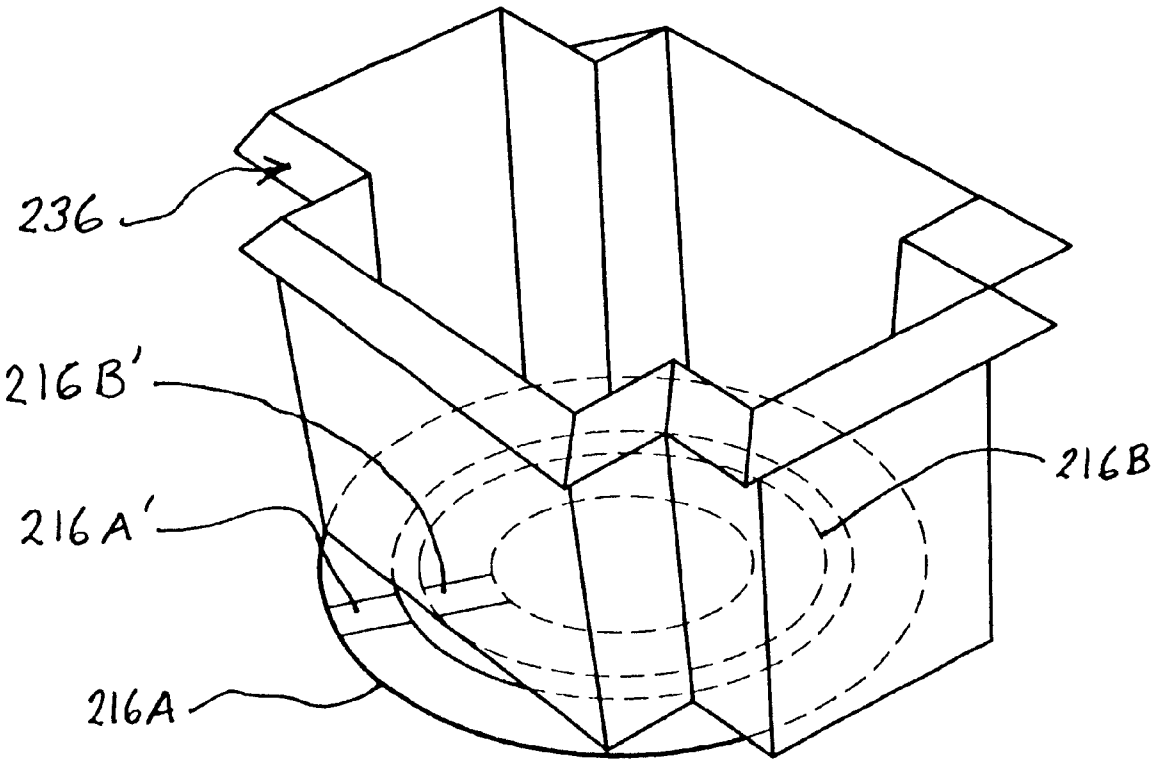
FIG. 9B is a top perspective view of the target and float assembly for the second alternative embodiment.

FIG. 9A shows another alternative embodiment of the invention for generating steam. It includes a tray 214 and a cover 248 which define a boiling chamber. A vent 252 is provided in the cover for releasing steam. The cover includes a recessed portion 280 having a bottom wall 242 for supporting an inductor coil 218. As shown in FIG. 9B, a metal target 216 in the form of a pair of concentric rings 216A, 216B is positioned in proximity to the bottom surface of the bottom wall 242 when the water in the tray reaches a desired level. Each ring preferably includes a fusible section 216A', 216B' having a lower melting point than the remainder of the ring. The target is coupled to the bottom wall of a cup 236 which includes a recess conforming to the configuration of the recessed portion 280 of the cover. The recessed portion 280 is nestable in the cup, allowing the target 216 to be aligned with the inductor coil 218. A ferrite block 258 supports the coil. The cup displaces a sufficient amount of water in the tray such that it floats to the position shown in FIG. 9A when the tray is filled with water.

Figure 10A:
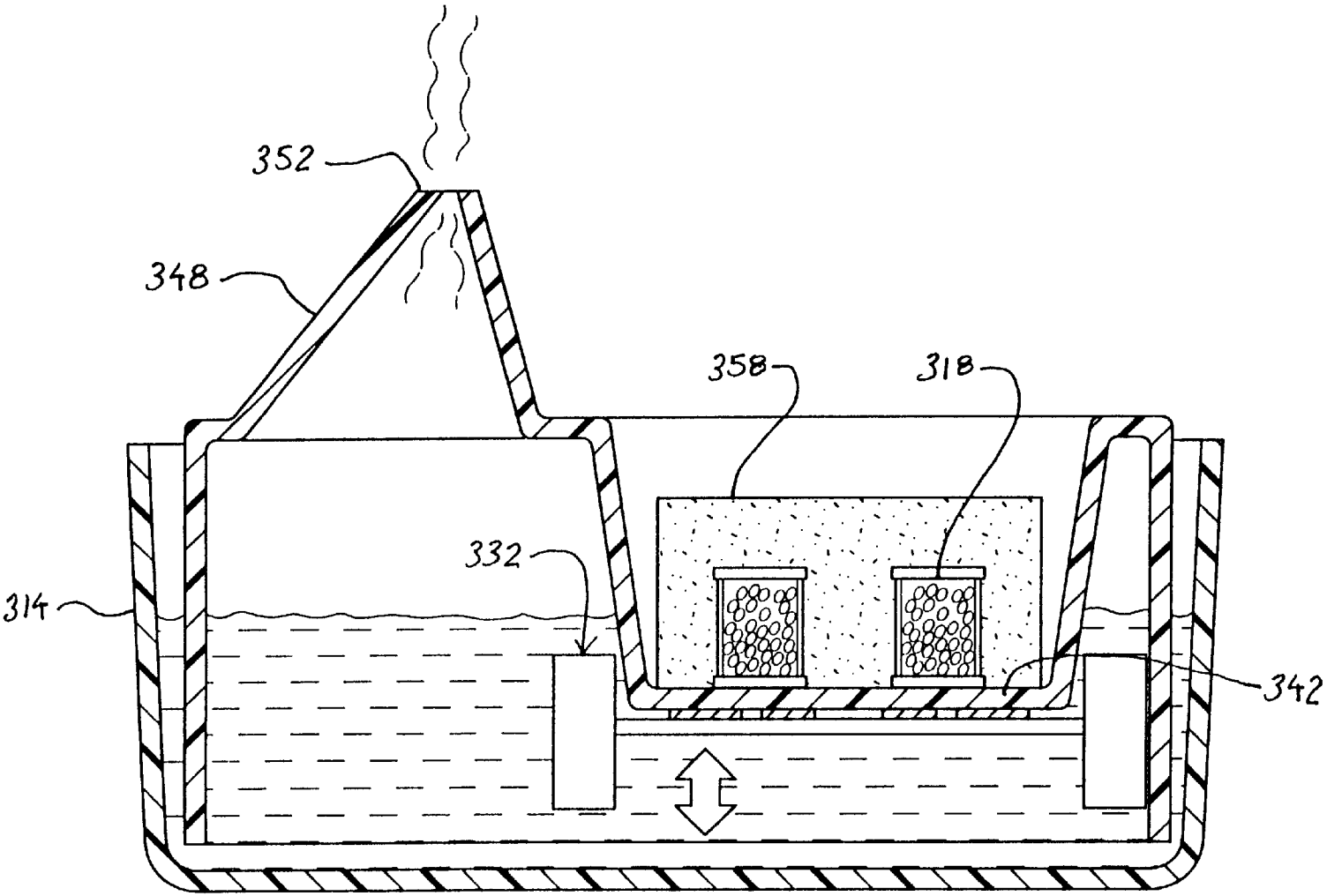
FIG. 10A is a sectional elevation view of a third alternative embodiment of the portion of the humidifier used for making steam.
Figure 10B:
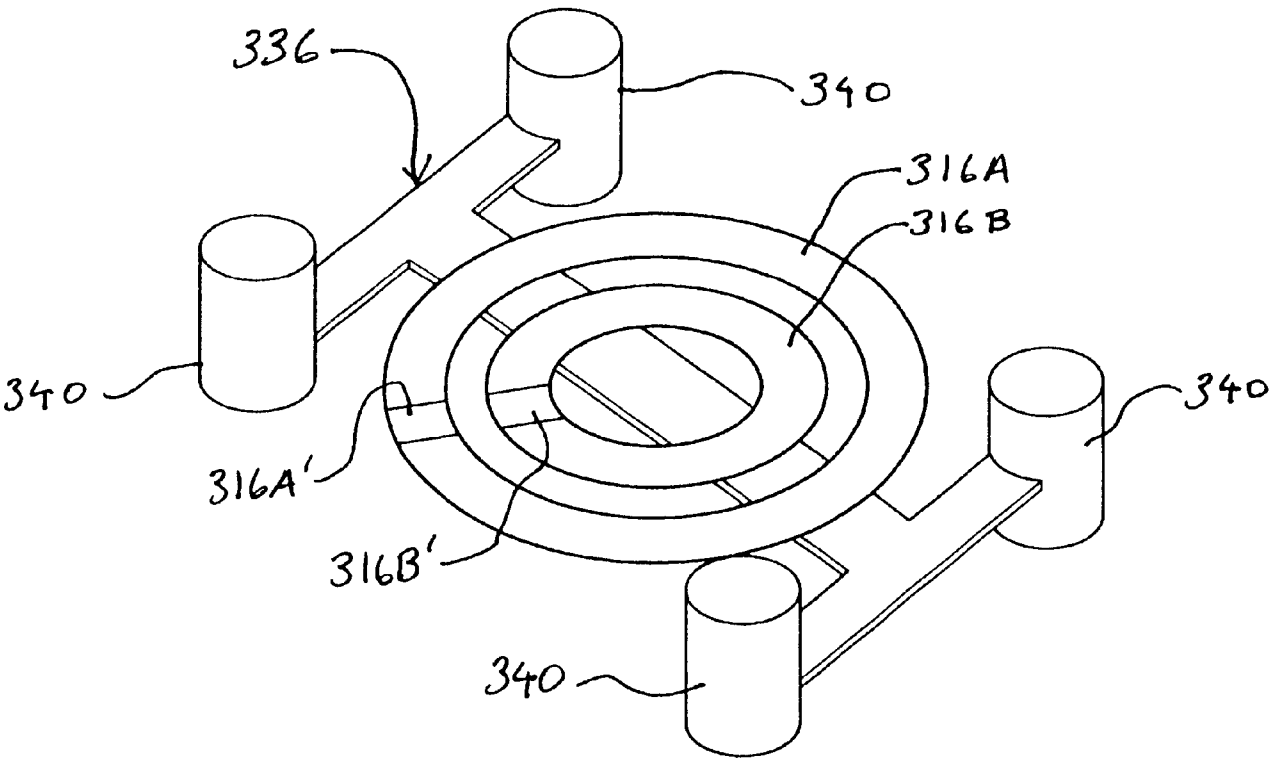
FIG. 10B is a top perspective view of the target and float assembly for the third alternative embodiment.

FIG. 10A shows an alternative embodiment of the invention, while FIG. 10B shows a target assembly 332 for use in this embodiment. The humidifying apparatus shown in FIG. 10A includes a tray 314 and a cover 348 which together define a boiling chamber. The cover includes a vent 352 for releasing steam therefrom. It further includes a recessed portion 380 having a bottom wall 342 for supporting an inductor coil 318 and ferrite support 358.

The target assembly 332 includes a pair of concentric metal rings 316A, 316B made from stainless steel or other suitable material. Each ring includes a fusible section 316A', 316B'. The rings are secured to a support 336. Floats 340 are mounted to the support, and provide sufficient buoyancy for allowing the target rings 316A, 316B to engage the bottom wall 342. Guides (not shown) may be provided to ensure that the target assembly is maintained beneath the recessed portion 380 of the cover and that the target rings are in alignment with the inductor coil. Such guides may also be employed in the embodiment of the invention shown in FIG. 9A.

The humidifier may be equipped with a microprocessor or other electronics for controlling its operation. The options of manual and automatic operation are preferably, though not necessarily, provided. Displays showing power on, high and/or low modes or operation, and humidity are also preferred. Use of a humidity detector allows automatic operation of the humidifier. In the automatic mode, the user would set the desired humidity. If the room humidity is less than the desired humidity level, the inductor coil would be powered until the humidity reaches the set level. Whether used manually or automatically, power to the inductor coil is shut off when the water tank is below a preselected level or empty, and/or when the target assembly drops a sufficient amount such that the distance between the inductor coil and metal target exceeds a certain threshold. The latter can be accomplished by means of an induction sensor 60, shown in FIG. 4. Additionally or alternatively, a water gauge or separate float in the tank and/or tray may be provided in conjunction with a switch for the purpose of shutting off power to the inductor coil under low water level conditions. Such float/switch assemblies have been used in prior art warn mist humidifiers. The fan can continue to run either until an on/off switch is actuated, or for a preselected time, upon shutting off power to the inductor coil. It should run at least as long as power is supplied to the inductor coil. Power to the inductor coil may be cut off if the fan either fails to operate or discontinues functioning. Power to the inductor coil is also preferably terminated upon disconnection of the housing for the electrical components and the base 26. This can be accomplished by a switch between the power supply and the inductor coil which is opened upon separation of these components.

While there have been described what are presently believed to be the preferred embodiments of the invention, those skilled in the art will realize that various changes and modifications may be made to the invention without departing from the spirit of the invention.

What is claimed is:

1. A humidifier comprising:

a tray defining a chamber;

a metal target movably positioned within said chamber;

an inductor coil for heating said metal target;

a wall separating said inductor coil from said metal target; and a float coupled to said metal target.

2. A humidifier as shown in claim 1 including a base defining an enclosure, a water tank removably coupled to said base, said tray being within said enclosure and in fluid communication with said tank.

3. A humidifier as described in claim 2 wherein said tray is removably positioned within said enclosure and below said wall.

4. A humidifier as described in claim 1 including a support, an arm pivotally coupled to said support, said metal target being mounted to said arm.

5. A humidifier as described in claim 4 wherein said support is coupled to said tray.

6. A humidifier as described in claim 1 wherein said wall includes top and bottom surfaces having channels formed therein, said metal target being positioned beneath said bottom surface, said channels permitting air circulation between said top surface and said inductor coil, said channels permitting water to move between said metal target and said bottom surface even if said metal target abuts said bottom surface.

7. A humidifier as described in claim 6 wherein each of said top and bottom surfaces of said wall is corrugated.

8. A humidifier as described in claim 6 including a fan for causing air to be moved over said inductor coil.

9. A humidifier as described in claim 8 including a housing containing said inductor coil and said fan, said wall separating said inductor coil from said metal target being a bottom wall of said housing.

10. A humidifier as described in claim 1 including an induction sensor and means for terminating power to said inductor coil connected to said induction sensor.

11. A humidifier as described in claim 1 wherein said metal target includes a fusible section.

12. A method for providing humidity, comprising:

providing a tray, a metal target within said tray, an inductor coil, and a wall separating said inductor coil and said target;

providing water to said tray;

maintaining said metal target at a position corresponding to the water level within said tray; and supplying power to said inductor coil, thereby causing said metal target to heat said water sufficiently to produce steam.

13. A method as described in claim 12 including the step of terminating power to said inductor coil when said water level in said tray drops below a selected level.

14. A method as described in claim 12 including the step of causing said metal target to float within said tray.

15. A method as described in claim 12 including the step of causing said metal target to pivot about a selected axis.

16. A method as described in claim 12 including the step of maintaining said metal target in engagement with said wall.

17. A portable humidifying apparatus comprising:

a removable tray for holding water;

a metal target movably positioned within said tray;

an inductor coil for heating said metal target with an induced current; and a wall separating said inductor coil and said metal target, said metal target being engageable with said wall.

18. An apparatus as described in claim 17 including a circuit for sensing the current induced in said metal target and terminating power to said inductor coil if said induced current drops below a preselected level.

19. An apparatus as described in claim 18 including a float coupled to said metal target.

20. An apparatus as described in claim 19 including a support, said float being pivotally coupled to said support.

21. An apparatus as described in claim 18 wherein said wall includes a bottom surface and a plurality of channels are provided between said bottom surface and said metal target.

22. An apparatus as described in claim 17 including a removable water tank in fluid communication with said tray.

23. A portable humidifier comprising:

a tray for holding water;

a metal target movably positioned within said tray;

an inductor coil for heating said metal target;

a wall separating said inductor coil from said metal target;

means for energizing said inductor coil; and means for deenergizing said coil when the water level in said tray drops below a predetermined level.

24. A portable humidifier as described in claim 23 wherein said means for deenergizing includes an induction sensor.

25. A portable humidifier as described in claim 24 including means for moving said metal target into engagement with said wall.

26. A portable humidifier as described in claim 25 wherein said wall includes a bottom surface defining a plurality of channels.

27. A portable humidifier comprising:

a tray for holding water;

a metal target positioned within said tray;

an inductor coil for heating said target;

a wall separating said metal target and said inductor coil, said metal target positioned beneath and engaging said wall, and a plurality of channels between said metal target and said wall for allowing the passage of water therein.

28. A portable humidifier as described in claim 27 including means for moving said metal target away from said wall upon a drop in water level in said tray.

29. A portable humidifier as described in claim 28 wherein said inductor coil has a substantially flat configuration and said metal target has a substantially flat body, said metal target being in parallel relation to said inductor coil.

30. A portable humidifier as described in claim 28 including means for energizing said coil, and means for deenergizing said coil upon a drop in water level in said tray.

* * * * *